US007122766B1

(12) United States Patent
Main

(10) Patent No.: US 7,122,766 B1
(45) Date of Patent: Oct. 17, 2006

(54) RANGE ANTI-TIP DEVICE AND METHOD

(76) Inventor: Bruce Whitford Main, P.O. Box 8109, Ann Arbor, MI (US) 48107

( * ) Notice: Subject to any disclaimer, the term of this patent is extended or adjusted under 35 U.S.C. 154(b) by 0 days.

(21) Appl. No.: 11/218,861

(22) Filed: Sep. 2, 2005

(51) Int. Cl.
*F24C 7/08* (2006.01)

(52) U.S. Cl. ..... 219/414; 219/494; 219/510; 99/337; 126/19 R; 126/190

(58) Field of Classification Search ..... None
See application file for complete search history.

(56) References Cited

U.S. PATENT DOCUMENTS 2,707,225 A * 4/1955 Pearce ..... 126/19 R
4,300,524 A 11/1981 Elsasser
4,669,695 A * 6/1987 Chou ..... 248/500
5,076,525 A 12/1991 Whipple
5,624,098 A 4/1997 McDowell
6,533,238 B1 3/2003 Barnes et al.
6,570,136 B1 * 5/2003 Lockwood et al. ..... 219/398

* cited by examiner

*Primary Examiner*—Joseph Pelham
(74) *Attorney, Agent, or Firm*—Wood, Herron & Evans, L.L.P.

(57) ABSTRACT

A method and safety control are provided for a free standing kitchen range which reduces the likelihood that the range will tip due to a child climbing onto the oven door. The safety control is configured to cause the oven door to be heated whenever a cooktop burner or element is on or is hot. The oven door heating can be achieved by turning on the oven burner or by energizing a door heating element that can be provided for that purpose. If the oven is in use or otherwise hot, any additional heating by the safety control is disabled. The safety control can be disabled manually for energy conservation when there are no children to protect. Electric and gas ranges can be provided with the feature.

16 Claims, 2 Drawing Sheets

RANGE ANTI-TIP DEVICE AND METHOD

The present invention relates to a stability safety control system for a free standing range, either gas or electric. More particularly the invention relates to a method and apparatus for reducing the likelihood of tipping of a range, including tipping due to the inclination of children to climb on the door.

BACKGROUND OF THE INVENTION

The kitchen range industry has been aware of range tipping problems for decades. To date, methods used by nearly all range manufacturers to prevent range tips include: providing anti-tip or stability brackets to be installed at the rear legs of the range to attach the range to the floor or wall, providing installation instructions for installing the brackets, placing on-product warnings to the installer warning the installer with regard to the range tip hazard and the importance of installing the stability bracket, attaching on-product warnings for the end user regarding the hazard of range tipping and ways to avoid instability, and providing instructions in the owners' manual on how to avoid range tip situations. When installed, stability brackets are effective in preventing range tipping. However, to be effective, the brackets must be properly installed, but the proper installation of brackets, or the use of such brackets does not always occur.

In spite of the industry efforts, range manufacturers are still seeing a number of range tip incidents. Past cases have typically included small children opening and climbing on the range door. In such cases, ranges tip and children are very badly burned when hot water, grease or food cooking on the cooktop spills onto the children. The resulting injuries to these children can be quite severe. Claims against range manufacturers and the costs to defend against those claims can be substantial. Such claims have been based on the failure to provide ways to adequately prevent injuries from range instability incidents.

Engineers have testified to the difficulty of solving this problem beyond the methods used to date. They have indicated that the current state of the art provides the greatest reduction in the risk of range instability, and that other concepts are not currently feasible or are less effective in the range manufacturing environment. Such other concepts that have been suggested include: tethering the range at the rear, using microchip tip detection sensors, providing extension legs, moving range legs forward, providing counterweights, using break away hinges or lowering devices, providing interlock switches or door latches, or combinations of these features. Other concepts have been advanced as potentially viable but have been determined to be infeasible. A range manufacturer that develops an effective solution to range tipping can gain competitive advantage in the market place. As a result, there is value in developing a solution to preventing ranges from tipping and the injuries associated with tips.

SUMMARY OF THE INVENTION

An objective of the present invention is to provide a stability or anti-tip safety device and method for a free standing kitchen range and oven that overcomes the problems and limitations of the prior art.

According to principles of the present invention, a free-standing range that includes a cooktop and oven is provided with a stability safety control system. The control system activates the oven burner to warm the oven whenever the cooktop is energized. As a result, the oven is heated to warm the inner panel of the oven door so that the door is hot to the touch if and when the door is opened. This temperature is sufficiently high to dissuade children from climbing on the oven door, thus preventing a major cause of range instability. In the preferred embodiment, portions of the oven door likely to be touched by a child climbing on the range are heated to a temperature sufficiently high to cause the child to back away if these portions are touched, but not to a temperature that will itself inflict burns on the child.

The temperature of the oven door that will deter a child but not burn a child is preferably approximately 120° F. This temperature is most likely to be satisfactory, with temperatures in the range of from somewhat less than 120° F. to several degrees more than 120° F. usually being acceptable. Temperatures of 115° F. may deter some but not all children, and lower temperatures are not likely to be sufficient to stop a child before the child climbs onto the door. Temperatures of 125° F. can be used, but as the temperature is increased, the duration of contact that will begin to cause burns decreases. Temperatures above 125° F. may result in severe burn injuries to young children.

In accordance with the present invention, a range stability safety control system is provided that operates such that, when any one burner on the range cooktop is activated, the control system enables gas or electricity to flow to the selected cooktop burner and also to the oven. When the cooktop is in use, the oven control system is set to warm the oven to a minimum temperature setting, which may be, for example, approximately 120° F. If the user wishes to use only the oven, the oven can be turned on with the oven thermostat set to a selected temperature level, which will be higher than the approximately 120° F. setting by the safety control system. In this instance the oven will operate normally to maintain the desired temperature and the control system will have no impact on the range's performance. If both the cooktop and the oven are used, the control system will allow the oven thermostat to operate normally to maintain the oven at the desired temperature. If neither the cooktop nor oven is on, the control system will be inactive and the range will be off.

Not all end users of a range have children present or are otherwise at significant risk of encountering a range instability situation. Such end users may find that the stability safety control system unnecessarily increases the energy used by the range or undesirably warms the oven and kitchen thereby. For such a case, a switch or other control element is provided to turn off the stability safety control for users who determine that the risk of range instability in their residence is sufficiently low as to warrant turning the system off. To turn off the range stability safety control system, the user will need to use a key or a tool, such as a screw driver, wrench or other tool. If the end users of a range decide that the risk of the range becoming unstable is insignificant, the end user will be able to turn off the range safety stability control system by manually turning or electronically activating a valve or a switch that will decouple the cooktop and range operation. When the stability safety control is deactivated, the oven functions normally and independent of the cooktop.

This range stability safety control system applies to both electric and gas free standing ranges. This range stability safety control system applies to ranges of all sizes. This range stability control system can be implemented in a large variety of electrical, electromechanical or mechanical devices using electronic or mechanical switches, electronic, mechanical or fluid valves, or other electronic or mechanical or other control components or combinations thereof.

The invention reduces the likelihood of accidents due to range tipping or otherwise caused by a child climbing onto the oven door, and does so without depending on the range user or the range installer taking specific action to install or enable safety hardware or safety features.

These and other objects and advantages of the present invention will be more readily apparent from the following detailed description of illustrated embodiments of the invention.

DETAILED DESCRIPTION OF THE DRAWINGS

Figure 1:
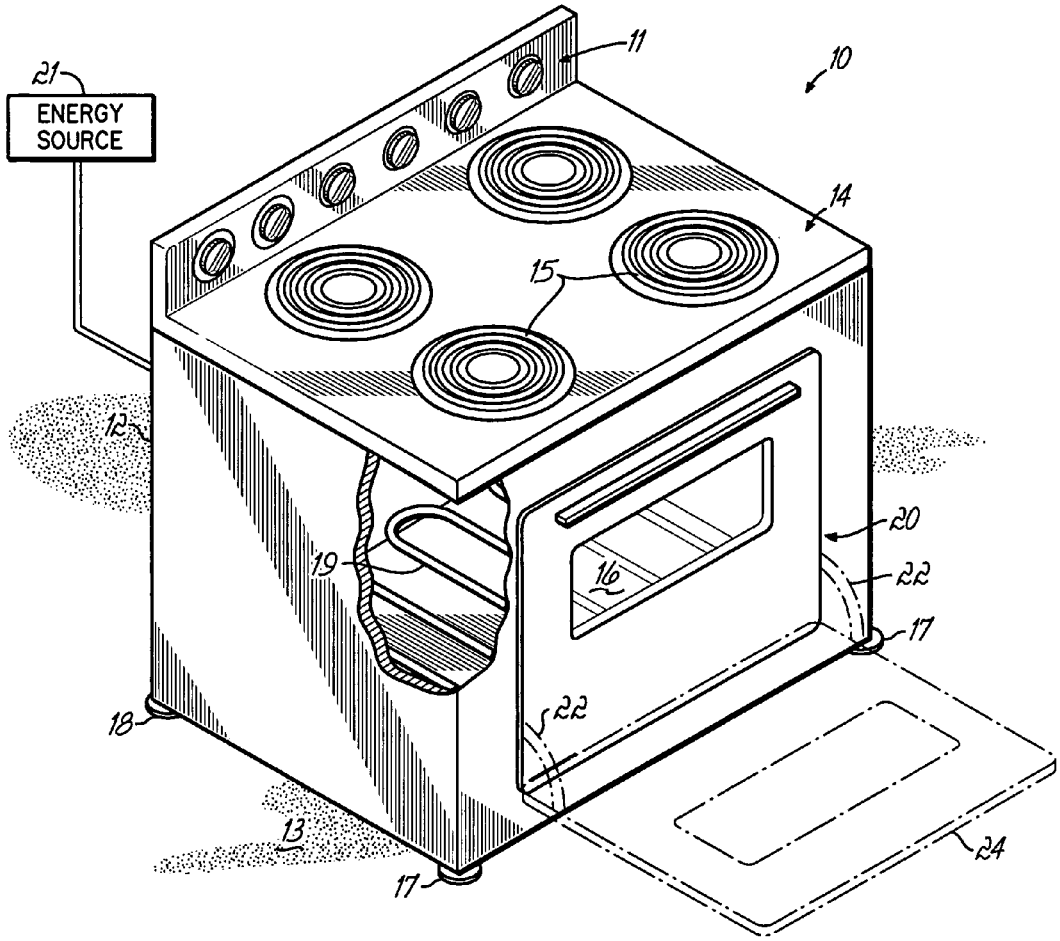
FIG. 1 is a perspective diagram of a kitchen range having an anti-tip safety control feature according to principles of the present invention.

FIG. 1 illustrates a free-standing kitchen range 10 that includes a cabinet 12, which rests on a floor 13. An upwardly facing upper cooktop surface 14 having a plurality of burners or heating elements 15 is provided on the top of the cabinet 12. An oven 16 having one or more heating elements 19 is enclosed in the cabinet 12. The cabinet typically is provided with a pair of front feet or pads 17 and a pair of back feet or pads 18 which support the range 10 on the floor 13. A control panel 11 contains user accessible controls for operating the heating elements 15 and 19 by selectively applying energy from an electric or gas energy source 21 to the heating elements 15 and 19.

An oven door 20 is provided in the front of the cabinet 12 which provides access to and seals the oven. In the typical range 10, the oven door 20 has hinges 22 at its sides near the bottom and opens outwardly, pivoting from a vertical orientation, as shown, at which the oven is closed, to a horizontal orientation 24, shown in phantom, at which the oven is open for access to the oven compartment. When in the open position in the horizontal orientation 24, the door 20 serves as a shelf at the level of the bottom of the oven compartment on which hot items can be set by the person preparing food in the oven.

Figure 1A:
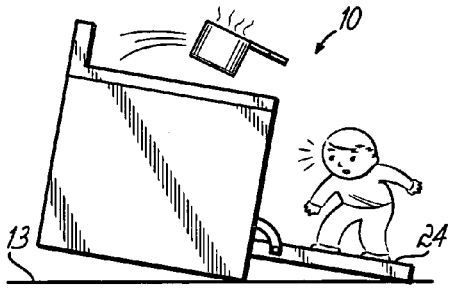
FIG. 1A is an elevational diagram of a kitchen range illustrating problems of the prior art.

The oven door 20 when in the open position 24 provides a hazard for injury to a child, who, by climbing onto the open oven door can reach hot items on the cooktop 14. A number of burn injuries to children have been experienced by children reaching the cooktop in this manner. More seriously, the cantilevered oven door 20, when in the open position 24, provides a moment arm that magnifies the force exerted by the weight of a child climbing onto the open oven door 20, which can cause the range to pivot forward on its front feet 17, lifting the back feet 18 from the floor 13, and tipping the range 10 forward. When so tipped, hot items can spill or fall from the cooktop 14 onto the climbing child, as illustrated in FIG. 1A.

When the oven 16 is being operated, the inside of the door 20 becomes hot. If the a child were to open the oven door 20 to climb upon it when the door is hot, the heated inner surface of the door 20, which is its upwardly facing side when the door 20 is in the horizontal orientation 24, will be hot enough to deter the child from climbing upon it. For this reason, few tipping accidents occur when the oven is in use. On the other hand, when the oven is unused and is cold, the oven door 20 provides a step for the child to climb to reach the cooktop 14. As a result, tipping accidents occur most frequently under these circumstances.

Figure 2:
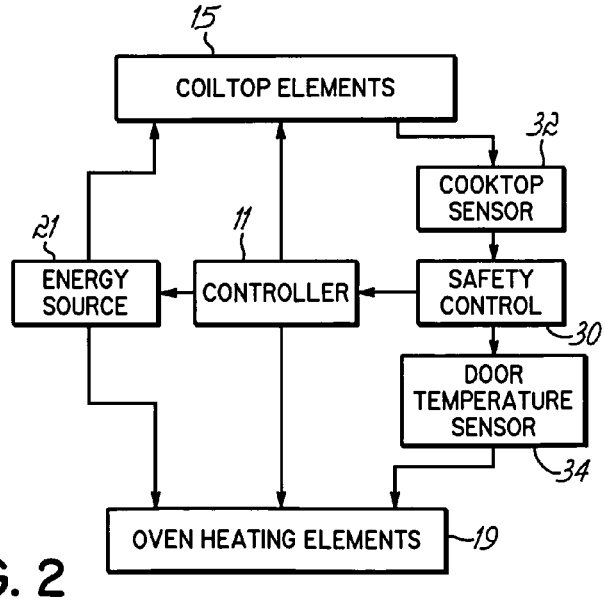
FIG. 2 is a schematic diagram of the kitchen range of FIG. 1 having an anti-tip safety control according to certain embodiments of the present invention.

According to principles of the present invention, whenever the cooktop 14 is being used or is hot, the oven door 20 is also caused to heat to a temperature sufficiently high that a child will be deterred from climbing upon it. The heating of the door 20 under these circumstances is brought about by a safety control 30, illustrated in FIG. 2. As depicted in FIG. 2, the oven controller 11 is coupled to the cooktop heating elements 15 and the oven heating elements 19 to selectively connect the elements 15 and 19 to the energy source 21. A sensor or sensing circuit 32 is also provided for detecting an operating condition of any of the heating elements 15 on the cooktop 14. Typically, the sensor 32 is coupled to the elements 15 to provide a signal to the safety control 30 indicating whether the cooktop element 15 is in use or is hot. In response to the sensing of a hot or in-use cooktop 14, the safety control 30 causes the oven heating element 16, or another element in the door provided for that purpose, to activate and heat the oven door 20.

The heating of the oven door 20 under the control of the safety control 30 is such that the door temperature will be hot enough to deter a child from climbing upon it, typically around 120° F. or higher, but not so high that the child will be burned, typically not more than 125° F. This temperature is sensed by the oven temperature sensor 48 (in FIG. 3) or a door temperature sensor 34, which provides the door temperature information to the safety control 30. If the oven 16 is in use and the oven door 20 is heated as a result of the use of the oven 16, as sensed by the sensor 34, heating under control of the safety control 30 will not proceed further.

Figure 3:
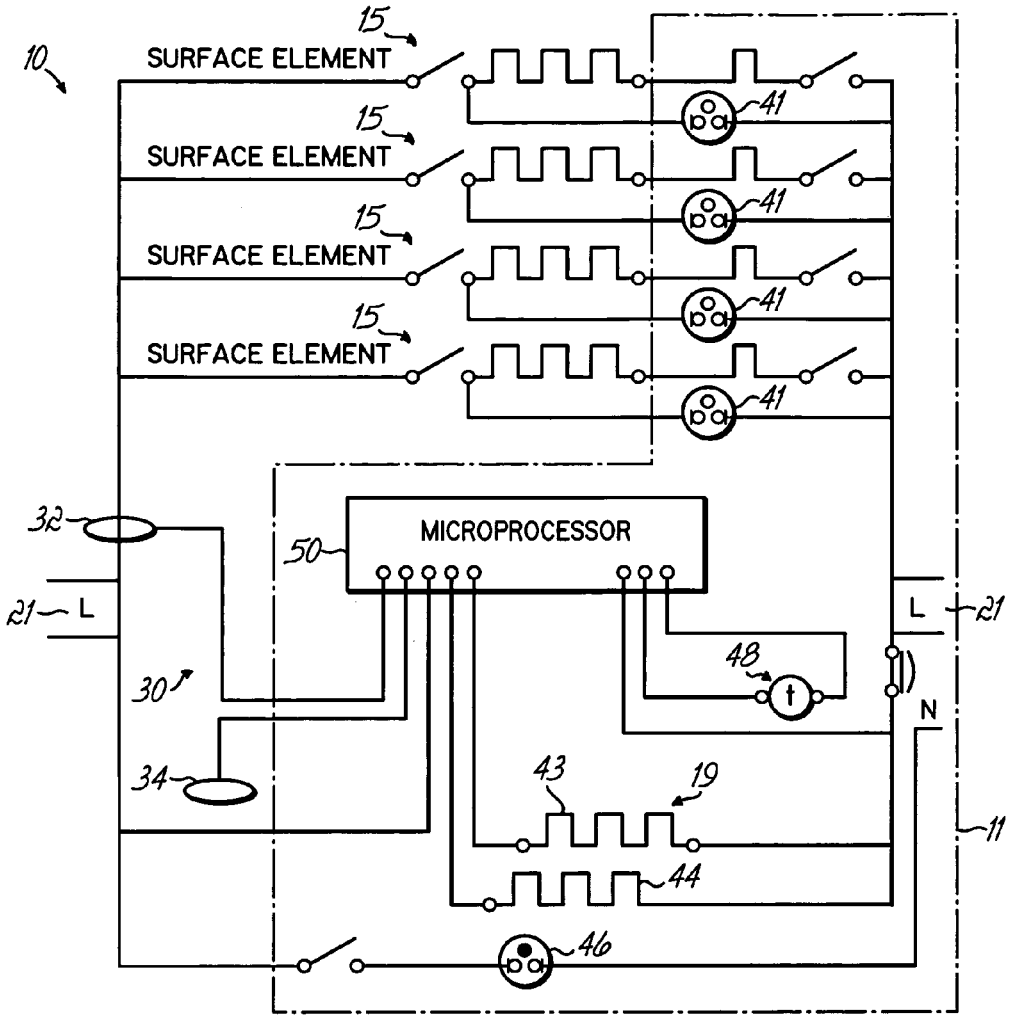
FIG. 3 is a schematic diagram of an embodiment of the kitchen range control of FIG. 2 for an electric range.

The range stability system that employs the safety control 30 in a range 10 can be implemented in a variety of electrical, electromechanical or mechanical ways or combinations thereof. One such method for an electric range 10 is illustrated in FIG. 3. In the electric version of the range 10, range top or burner elements 15 are each controlled by using a standard infinite switch, a dual infinite switch, an electronic top element system or similar temperature controls in the range control system 11. The most basic method is the standard infinite or continuous setting switch 41. The surface elements 15 and standard infinite switches 41 provide an infinite choice of heat settings for cooking. Controls are preferably of a safety type that must be pushed before turning. All surface controls are marked on the control panel of the range control 11 for their respective heating elements. Power is supplied to the surface elements 15 from an electric power source 21, which is typically 220 VAC in the US, through the infinite switch contacts by providing continuous power to the element for high heat or cycled (on-off for a time interval or duty cycle) to maintain the correct heat setting.

The oven heating elements 19 of an electric version of the range 10 include a bake mode element 43, which provides a controlled temperature in the cavity of the oven 16, and an optional broil element 44. When the bake element 43 is activated and oven temperature is set with a control pad or with a rheostat 46, a bake relay (not shown) closes to connect the element 43 to the electric power source 21. This connects one side of the power source line to the bake element 43. An oven temperature sensor 48 is provided which has in its tip a positive thermistor that increases in resistance as the oven temperature increases. A microprocessor 50, which may be provided in the range control 11, reads the resistance of the oven sensor, and compares it with a programmed or selected temperature. When the resistance of the oven sensor indicates temperature in the oven is about 10 degrees above the programmed temperature, the microprocessor 50 opens the bake relay, which removes power from one side of the element 43. When power is removed from the element, the oven temperature begins to lower. As the oven temperature lowers, the resistance of the oven sensor decreases. When the oven drops to about 10 degrees below the programmed temperature, the resistance of the sensor tells the microprocessor to close the bake relay contacts, and provide power to the bake element once again.

The stability safety control 30 may include a coil sensor 32 that may be placed on the power input to the top element control system 11. When the user activates a burner element 15, current will flow to the burner. The coil sensor 32 senses the current flow and closes a normally open relay (not shown), which may be in the microprocessor 50 in the form of added software or in a separate processor. This relay enables current to flow from the power source 21 to the bake heating element 43 in the oven 16 causing the bake element to heat. The safety control 30 relies on a sensor 34 to determine the temperature of the oven door 20. The oven door temperature sensor may rely on the general oven temperature sensor 48 or may be a separate sensor 34 in the door 20. In the tip of the oven sensor 48 or door temperature sensor 34 is a positive thermistor that increases in resistance as the oven temperature increases. The microprocessor 50 reads the resistance of the thermistor and compares the read temperature with the preset temperature of, for example, 120 degrees Fahrenheit. When the resistance of the sensor 34 indicates a temperature in the oven is about 10 degrees above the preset temperature (about 130 degrees F.), the microprocessor 50 opens the relay, which removes power from one side of the element. When power is removed from the element the oven temperature begins to lower. As the oven temperature lowers, the resistance of the oven sensor decreases. When the oven drops to about 10 degrees below the preset temperature (about 110 degrees F.), the resistance of the sensor tells the microprocessor 50 to close the bake relay contacts, and provide power to the bake element once again.

In some instances, consumers may wish to override the stability safety control system and decouple the operations of the burner elements and the oven. This might be desirable when there are no children on the premises and energy conservation is desired by avoiding the heating of the oven door when the oven is not otherwise in use. This will be permitted by the use of a key or tool such as a screwdriver, which can deactivate the oven door heating function, such as by deactivating the cooktop sensor 32 or recalibrating the oven temperature sensor 48 to remain off. When the coil sensor 32 is deactivated, the burner and oven elements will operate independently and normally.

Where the range 10 is a gas range, some electronic controls and mechanical controls are typically present. Gas ranges with electronic controls usually operate in a similar manner to the electric range described above. When the user turns on a surface burner infinite control valve, gas flows through the valve to the selected burner and an electronic signal is sent by a microprocessor to cause an electronic ignition to ignite the gas. With the stability safety control system, when the burner valve is turned on, a signal from the microprocessor would open a gas valve allowing gas to flow to the oven burner. The gas would be ignited using the same ignition source currently used in the oven. The gas flow would cycle on and off to maintain the oven temperature at or about 120 degrees Fahrenheit using the thermistor as described above.

Figure 4:
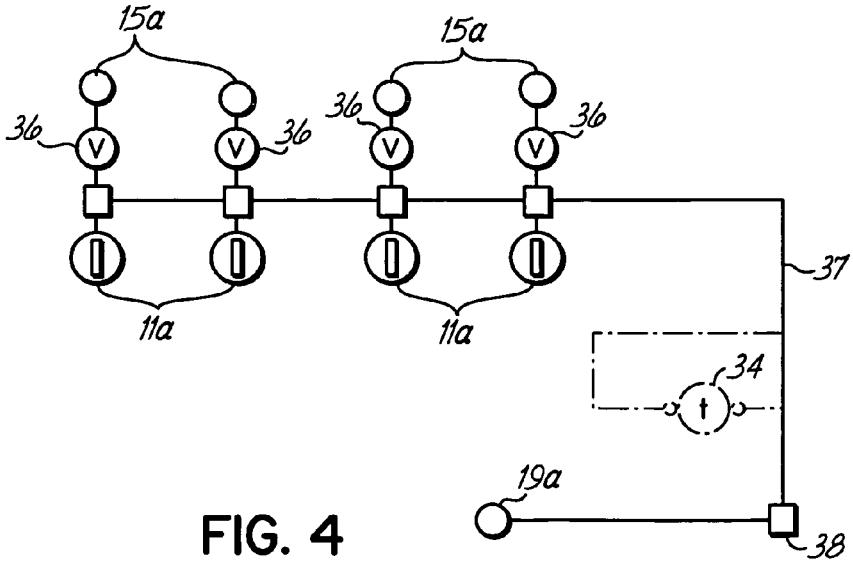
FIG. 4 is a schematic diagram of an embodiment of the kitchen range control of FIG. 2 for a gas range.

Gas ranges with only mechanical controls may have pilot lights for the surface burners 15*a* and another for the oven burner 19*a*, as illustrated in FIG. 4. Each burner 15*a* is provided with a control knob 11*a* which controls a gas valve 36. When the burner control knob 11*a* is turned on, a heating of the oven according to the present invention can be brought about by providing a mechanical switch 38 that would be activated by a raised edge or cam on the surface of the shaft 37 of the valve 36 to the cooktop burner 15*a*. The switch 38 in turn allows gas to flow to the oven burner element 19*a*. Alternatively, a single gas burner control valve can, when opened, be made to simultaneously allow gas to flow to the oven burner element. Gas flowing to the oven burner element 19*a* would be ignited by a standing oven pilot light. A thermostat 34 in the oven that controls the oven temperature can be preset to maintain the oven at about 120 degrees Fahrenheit, cycling the gas on and off as necessary to maintain an average temperature. If the oven temperature control is turned to a higher temperature setting by the user using the oven, the higher set temperature would be maintained. An optional override of the safety feature can be provided.

Although only certain exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A method of operating a range unit having a cooktop and an oven so as to reduce the likelihood of an accident due to the climbing of a person onto the oven door, the method comprising:

maintaining the temperature of a surface of the oven door at a level that is hot to the touch in response to the use of or temperature of the cooktop.

2. The method of claim 1 further comprising:

sensing the use of or temperature of a burner on the cooktop;

the maintaining of the temperature of the surface of the oven door is in response to the sensing of the use of or temperature of the burner on the cooktop.

3. The method of claim 1 wherein:

the maintaining of the temperature of the surface of the oven door includes either activating an oven burner in the oven to heat the inner surface of the oven door or energizing a heating element in the oven door.

4. The method of claim 1 wherein the maintaining of the temperature of the surface of the oven door includes:

sensing the temperature or otherwise determining the use of the oven and heating the surface of the oven door in response to the sensing of the temperature or use of the oven.

5. The method of claim 1 wherein the maintaining of the temperature of the surface of the oven door includes:

determining the use of the oven and heating the surface of the oven door only upon a determination that the oven is not in use.

6. The method of claim 1 wherein the maintaining of the temperature of the surface of the oven door includes:

heating the oven to at least approximately 120 degrees Fahrenheit in response to the use of or temperature of the cooktop.

7. A range anti-tip control system for a range having a cooktop and an oven, comprising:

a cooktop sensor responsive to activation of a burner on the cooktop or the temperature of a burner on the cooktop; and a controller operative to energize a heating element in the oven in response to output from the cooktop sensor.

8. The control system of claim 7 further comprising:

an oven sensor responsive to activation of a burner in the oven or a temperature in the oven; and the controller being operative to limit the energizing of the heating element in the oven in response to the output of the oven sensor.

9. The control system of claim 7 wherein:

the cooktop sensor is responsive to the supply of energy to a burner on the cooktop;

whereby the controller will energize the heating element in the oven in response to the supply of energy to a burner on the cooktop.

10. The control system of claim 9 wherein:

the controller is operative to heat the oven in response to output from the cooktop sensor.

11. The control system of claim 7 wherein:

the controller is operative to heat the oven in response to output from the cooktop sensor.

12. A kitchen range comprising:

a cabinet having supports at the bottom thereof for supporting the range on a floor;

an upwardly facing cooktop having a plurality of upwardly facing cooktop units at the top of the cabinet;

an oven contained within the cabinet having at least one oven heating element therein and having a door in the front of the cabinet hinged and openable by downwardly pivoting to a horizontal orientation;

a sensor operable to detect an operating condition of a cooktop unit on the cooktop; and a control coupled to the sensor and operative to control a heater in the oven to maintain the inside of the oven door at a temperature that is hot to the touch when any one of the cooktop units in the cooktop is in an operating condition.

13. The range of claim 12 wherein:

the control is operative to control at least one oven heating element in the oven to maintain the inside of the oven door at said temperature when any one of the cooktop units is operating.

14. The range of claim 12 wherein:

the control is operative to maintain the inside of the oven door at a temperature of at least approximately 120 degrees Fahrenheit when any one of the cooktop units is operating.

15. The range of claim 12 wherein:

the range is an electric range having a plurality of heating elements in the cooktop, each having a heating control connected thereto that is operable to supply electricity to place the heating element in operating condition, the range also having at least one oven heating element in the oven; and the control is operative to control at least one oven heating element in the oven to heat the inside of the oven door to a temperature that is hot to the touch when any one of the heating elements of the cooktop is in an operating condition.

16. The range of claim 12 wherein:

the range is a gas range having a plurality of burner units in the cooktop, each having a gas control valve connected thereto that is operable, when open, to supply gas fuel to place the burner unit in operating condition, the range also having at least one oven burner in the oven; and the control is operative to control at least one oven burner in the oven to heat the inside of the oven door to a temperature that is hot to the touch when any one of the burner units of the cooktop is in an operating condition.

* * * * *